US010292421B2

(12) United States Patent
Nappi

(10) Patent No.: US 10,292,421 B2
(45) Date of Patent: May 21, 2019

(54) SMOKING ARTICLE FILTER INCLUDING DEGRADABLE FILTER COMPONENT

(71) Applicant: PHILIP MORRIS PRODUCTS S.A., Neuchatel (CH)

(72) Inventor: Leonardo Nappi, Vallamand (CH)

(73) Assignee: Philip Morris Products S.A., Neuchatel (CH)

( * ) Notice: Subject to any disclaimer, the term of this patent is extended or adjusted under 35 U.S.C. 154(b) by 252 days.

(21) Appl. No.: 15/035,054

(22) PCT Filed: Dec. 22, 2014

(86) PCT No.: PCT/EP2014/079052
§ 371 (c)(1),
(2) Date: May 6, 2016

(87) PCT Pub. No.: WO2015/092071
PCT Pub. Date: Jun. 25, 2015

(65) Prior Publication Data

US 2016/0270437 A1 Sep. 22, 2016

(30) Foreign Application Priority Data

Dec. 20, 2013 (EP) ..... 13199236

(51) Int. Cl.
*A24D 3/00* (2006.01)
*A24D 1/00* (2006.01)
(Continued)

(52) U.S. Cl.
CPC ..... *A24D 3/068* (2013.01); *A24D 1/02* (2013.01); *A24D 1/045* (2013.01); *A24D 3/0204* (2013.01);
(Continued)

(58) Field of Classification Search
CPC . A24D 3/068; A24D 3/08; A24D 3/14; A24D 3/10; A24D 1/045; A24D 3/0204;
(Continued)

(56) References Cited

U.S. PATENT DOCUMENTS 2,647,285 A 8/1953 Pfau
5,913,311 A * 6/1999 Ito ..... A24D 3/10 131/332
(Continued)

FOREIGN PATENT DOCUMENTS

CN 102458162 5/2012
GB 2489491 10/2012
(Continued)

OTHER PUBLICATIONS

PCT Search Report and Written Opinion for PCT/EP2014/079052 dated Mar. 24, 2015 (7 pages).
(Continued)

*Primary Examiner* — Linda L Gray
(74) *Attorney, Agent, or Firm* — Mueting, Raasch & Gebhardt, P.A.

(57) ABSTRACT

A filter for a smoking article includes a filter component formed from a solution of cellulose acetate and a degradable polymer in aceton, the degradable polymer being soluble in acetone and degrading in the presence of water. In a first aspect of the invention, the filter component is a filter segment (16) formed of a plurality of fibers formed from the degradable solution. In a second aspect of the invention, the filter component is a wrapper (39) circumscribing at least a segment of the filter.

14 Claims, 1 Drawing Sheet

Figure 1:
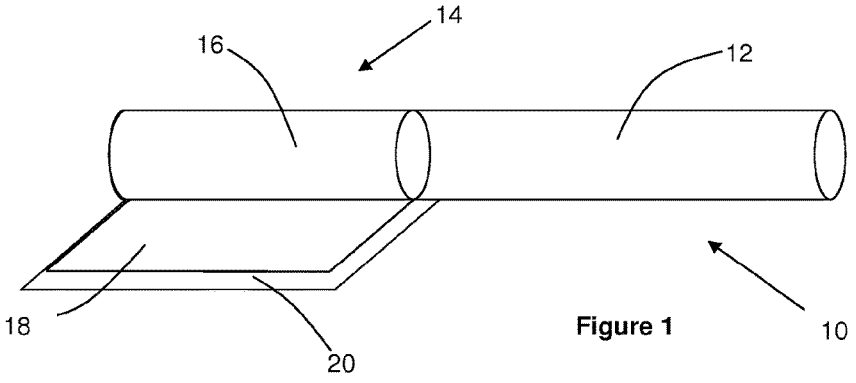

(51) Int. Cl.

| | |
|---|---|
| ***A24F 1/00*** | (2006.01) |
| ***D01F 8/00*** | (2006.01) |
| ***A24F 47/00*** | (2006.01) |
| ***A24D 3/06*** | (2006.01) |
| ***A24D 1/02*** | (2006.01) |
| ***A24D 3/10*** | (2006.01) |
| ***A24D 3/14*** | (2006.01) |
| ***A24D 1/04*** | (2006.01) |
| ***A24D 3/02*** | (2006.01) |
| ***A24D 3/04*** | (2006.01) |
| ***A24D 3/08*** | (2006.01) |
| ***D01F 8/02*** | (2006.01) |
| ***D01F 8/14*** | (2006.01) |

(52) U.S. Cl.
CPC ..... *A24D 3/04* (2013.01); *A24D 3/08* (2013.01); *A24D 3/10* (2013.01); *A24D 3/14* (2013.01); *A24F 47/006* (2013.01); *D01F 8/02* (2013.01); *D01F 8/14* (2013.01); *D10B 2201/22* (2013.01); *D10B 2331/041* (2013.01); *D10B 2401/12* (2013.01); *D10B 2505/04* (2013.01)

(58) Field of Classification Search
CPC ..... A24D 3/04; D01F 8/02; D01F 8/14; A24F 47/006
See application file for complete search history.

(56) References Cited

U.S. PATENT DOCUMENTS

| | | | | |
|---|---|---|---|---|
| 8,360,074 | B2 | 1/2013 | Sutton | |
| 9,107,454 | B2 * | 8/2015 | Rushforth | A24D 3/10 |
| 2011/0030709 | A1 | 2/2011 | Sebastian | |
| 2012/0000480 | A1 | 1/2012 | Sebastian | |
| 2012/0305014 | A1 * | 12/2012 | Richardson | A24D 1/02 131/284 |
| 2013/0025610 | A1 | 1/2013 | Sebastian | |

FOREIGN PATENT DOCUMENTS

| | | |
|---|---|---|
| JP | 2012-529276 | 11/2012 |
| WO | WO 2009/016513 | 2/2009 |
| WO | WO 2010/142498 | 12/2010 |
| WO | WO 2012/000479 | 1/2012 |
| WO | WO 2012/175979 | 12/2012 |
| WO | WO 2013/011301 | 1/2013 |
| WO | WO 2014/018645 | 1/2014 |

OTHER PUBLICATIONS

European Extended Search Report for Application No. 13199236.4 dated May 15, 2014 (7 pages).
Office Action issued in China for Application No. 201480066778.0 dated Dec. 19, 2018 (21 pages). English translation included.
Office Action issued in Japan for Application No. 2016-534233 dated Dec. 6, 2018 (19 pages).

* cited by examiner

SMOKING ARTICLE FILTER INCLUDING DEGRADABLE FILTER COMPONENT

This application is a U.S. National Stage Application of International Application No. PCT/EP2014/079052, filed Dec. 22, 2014, which was published in English on Jun. 25, 2015, as International Patent Publication WO 2015/092071 A1. International Application No. PCT/EP2014/079052 claims priority to European Application No. 13199236.4 filed Dec. 20, 2013.

The present invention relates to a smoking article filter comprising a degradable filter component and to a smoking article including such a filter. The present invention further relates to a method for the production of a filter including a degradable filter component.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material, usually cellulose acetate tow, circumscribed by a paper plug wrap. Conventionally, the wrapped tobacco rod and the filter are joined by a band of tipping wrapper, normally formed of a paper material, which circumscribes the entire length of the filter and an adjacent portion of the wrapped tobacco rod.

A number of smoking articles in which tobacco is heated rather than combusted have also been proposed in the art. In heated smoking articles, an aerosol is generated by heating an aerosol generating substrate, such as tobacco. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco material, tobacco extract or other nicotine source, without combustion and in some cases without heating, for example through a chemical reaction.

It has been previously proposed to produce filters for cigarettes using biodegradable or water soluble materials so that the cigarette butt that remains after smoking can be more readily degraded after its disposal. For example, it has been proposed to form fibrous filter segments with fibres of a biodegradable thermoplastic material, either alone or in combination with conventional cellulose acetate fibres. However, the production of such filter segments typically requires different manufacturing apparatus and techniques to those used for conventional cellulose acetate filter segments and this can have an adverse effect on productivity and costs.

It would be desirable to provide a filter for a smoking article that includes a degradable filter component which can be readily broken down or degraded in order to facilitate the disintegration and degradation of the filter as a whole after the disposal of the filter. It would be particularly desirable to provide such a filter that can be readily manufactured using existing apparatus and techniques without significantly impacting productivity.

According to the invention there is provided a filter for a smoking article, the filter including a filter component formed from a solution of cellulose acetate and a degradable polymer in acetone, the degradable polymer being soluble in acetone and degrading in the presence of water.

The solution comprising the cellulose acetate and degradable polymer will also be referred to in the following specification as the "degradable composition".

The term "degradable polymer" is used herein to refer to a polymeric compound that is chemically broken down through hydrolysis into smaller compounds in the presence of water molecules which may be present in the form of liquid water or water vapour. The hydrolysis of the polymer will typically be slower in the presence of water vapour than in the presence of liquid water. In the filters of the present invention, the chemical breakdown of the degradable polymer in the presence of water brings about a breakdown in the physical structure of the degradable composition. This in turn causes the filter component formed of the degradable composition to break apart so that the remainder of the filtration material in the filter can degrade more quickly due to the increase in the surface area exposed to the environment. Advantageously, filters in accordance with the present invention therefore expedite the degradation of the filter of a smoked article by providing a degradable filter component which will be broken down upon contact with water naturally present in the environment, so as to expose the remainder of the filtration material to the environment.

The degradable polymer of the composition used for forming a component of filters according to the invention is soluble in acetone. This advantageously enables the degradable polymer to be incorporated into a standard manufacturing process for a cellulose acetate filter component, as described in more detail below, without the need for the process to be modified. The degradable polymer can therefore be incorporated into the filter component without incurring additional processing costs and without adversely affecting the output of the process.

For the purposes of the invention, a polymer is considered to be soluble in acetone if at least 33 milligrams (mg) of the polymer dissolves per millilitre (ml) of acetone, at room temperature (22° C.).

Preferred degradable polymers for use in the present invention include but are not limited to polylactic-co-glycolic acid (PLGA), poly(propylene succinate). L-lactide/caprolactone copolymer, polycaprolactone and combinations thereof. Preferably, the degradable polymer is a co-polymer.

Preferably, the degradable polymer is biodegradable.

Preferably, the degradable polymer is substantially insoluble in water. Advantageously, the filter component formed of the degradable composition will not therefore dissolve upon exposure to water brought into contact with the filter during smoking, for example, from the consumer's mouth or from the mainstream smoke drawn through the filter.

In particularly preferred embodiments of the invention, the degradable polymer is polylactic-co-glycolic acid (PLGA). PLGA is a co-polymer formed of glycolic acid and lactic acid monomers which link to form a polyester. Preferably the ratio of the monomers in the PLGA is between about 40:60 and about 60:40, more preferably about 50:50, as this polymer has the highest rate of degradation in the presence of water. PLGA is soluble in acetone and degrades readily in the presence of water.

Filters according to the invention may include a single component or a plurality of components formed of a degradable composition comprising cellulose acetate and the degradable polymer. Typically, any filter component that is suitable to be formed from cellulose acetate may be formed from the degradable composition comprising cellulose acetate in combination with a degradable polymer.

In a first aspect of the invention, a filter is provided which includes a fibrous filter segment formed of a plurality of fibres comprising the degradable composition of cellulose acetate and a degradable polymer.

Advantageously, filters in accordance with the first aspect of the present invention deliver a similar taste to the consumer when compared with traditional cellulose acetate tow filters. The similar taste sensation is due to the inclusion of cellulose acetate within the fibres, which enables conventional plasticisers such as triacetin to be used to bind the fibres within the fibrous filtration segment, as described below. The fibres can therefore exhibit similar levels of selective phenol reduction during smoking of a smoking article incorporating the filter compared to traditional cellulose acetate tow filters. The filter segment can also provide a similar firmness to a cellulose acetate tow filter.

The use of a fibrous filtration material including fibres comprising the degradable polymer improves the degradation of the filter segment formed of the fibrous filtration material. This is in part due to the improved degradability of the fibres compared to cellulose acetate fibres. However, in addition, the breakdown of the degradable polymer in the presence of water will facilitate the dispersion of the fibres and the opening up of the filtration material. Increased dispersion of the fibres increases the exposure of the individual fibres to the environment, thus further increasing the rate at which the filtration material degrades.

Preferably, the plurality of fibres are formed of a degradable composition comprising at least about 10 percent by weight of the degradable polymer, more preferably at least about 25 percent by weight and most preferably at least about 40 percent by weight, based on total dry weight of the composition. Preferably, the degradable composition comprises less than about 75 percent by weight of the degradable polymer, more preferably less than about 60 percent by weight, based on the total dry weight of the composition.

In preferred embodiments, the fibres are formed of a degradable composition comprising between about 10 percent and about 75 percent by weight of the degradable polymer, more preferably between about 25 percent and about 75 percent by weight and most preferably between about 40 percent and about 60 percent by weight, based on the total dry weight of the composition. In a particularly preferred embodiment, the fibres are formed of a degradable composition comprising about 50 percent by weight of the degradable polymer, based on total dry weight.

In particularly preferred embodiments, the degradable polymer in the degradable composition forming the fibres is polylactic-co-glycolic acid (PLGA).

Preferably, the degradable composition forming the fibres comprises at least about 25 percent by weight of cellulose acetate, more preferably at least about 40 percent by weight, based on the total dry weight of the composition. Preferably, the degradable composition comprises less than about 90 percent by weight of cellulose acetate, more preferably less than about 75 percent by weight and most preferably less than about 60 percent by weight, based on the total dry weight of the composition.

In preferred embodiments, the fibres are formed of a degradable composition comprising between about 25 percent and about 90 percent by weight of cellulose acetate, more preferably between about 25 percent and about 75 percent by weight and most preferably between about 40 percent and about 60 percent by weight, based on the total dry weight of the degradable composition. In a particularly preferred embodiment, the fibres are formed of a degradable composition comprising about 50 percent by weight of cellulose acetate, based on total dry weight.

Preferably, the degradable polymer and the cellulose acetate constitute substantially all or a majority of the degradable composition forming the fibres. The fibres therefore preferably consist essentially of the degradable polymer and cellulose acetate. However, in certain embodiments, additional functional or non-functional components may be incorporated into the degradable composition forming the fibres. For example, in certain embodiments the degradable composition may include a plasticiser which is incorporated into the composition together with the cellulose acetate and the degradable polymer, prior to the formation of the fibres. Alternatively or in addition, the degradable composition may include a colourant, such as for example titanium dioxide. Where a colourant is included, the colourant preferably accounts for less than 2 percent by weight, more preferably less than 1 percent by weight, based on the total solid weight of the degradable composition.

Preferably, the fibrous filter segment further comprises at least one plasticiser applied to the plurality of fibres. This plasticiser is separate from any plasticiser which may optionally be added into the degradable composition forming the fibres, as described above. For the purposes of the present invention, the application of plasticiser to the fibres may be carried out in a similar manner to the application of plasticiser to conventional cellulose acetate tow filters, using corresponding apparatus and methods. Preferably, the plasticiser is sprayed onto the separated fibres during the production of the fibrous filter segment.

Advantageously, the use of cellulose acetate in the fibres of the filter according to the first aspect of the invention enables the use of conventional plasticisers that are known for use on cellulose acetate tow materials. As described above, this ensures that the inclusion of the degradable polymer into the fibres does not adversely impact the firmness of the fibrous filter segment compared to a traditional cellulose acetate tow, or the flavour experienced during smoking of a smoking article incorporating a filter according to the invention.

Suitable plasticisers for use in the present invention would be well known to the skilled person and may be selected from the plasticisers that are conventionally used for cellulose acetate tow. Examples of suitable plasticisers include triacetin, triethyl citrate and polyethylene glycol.

Preferably, the fibrous filter segment includes between about 1 percent and about 15 percent by weight of the plasticiser, more preferably between about 5 percent and about 10 percent, based on the total weight of the fibrous filtration material.

Preferably, the fibres of the degradable composition forming the fibrous filter segment are spun fibres, formed in a spinning process, most preferably a dry solvent spinning process using acetone as the solvent, as described below.

The fibres in the fibrous filtration material may be substantially aligned in the longitudinal direction of the filter and extend along substantially the entire length of the segment of fibrous filtration material. Alternatively, the fibres in the fibrous filtration material may be randomly oriented and extend only part way along the length of the segment of fibrous filtration material.

Preferably, the segment of fibrous filtration material comprising the fibres of the degradable composition has a denier per fibre of between about 1.5 and about 8.0 and a total denier of between about 15000 and about 46000.

Preferably, the segment of fibrous filtration material comprising the fibres of the degradable composition has a resistance to draw (RTD) of between about 80 mm WG and about 900 mm WG for a filter length of 108 mm, with all ventilation closed. As used herein, resistance to draw is expressed with the units of pressure 'mm WG' or 'mm of water gauge' and is measured in accordance with ISO 6565:2002.

The segment of fibrous filtration material may be entirely formed from the fibres of the degradable composition comprising cellulose acetate and the degradable polymer. Alternatively, the segment of fibrous filtration material may be formed of additional fibres of a different material in combination with the fibres of the degradable composition. For example, additional fibres of a different material may be included to further improve the degradability of the fibrous filtration material. Suitable additional fibres include but are not limited to fibres formed of cellulose or polylactic acid (PLA). One example of suitable cellulose fibres is Lyocell fibres, which are regenerated cellulose fibres formed from wood pulp. Lyocell fibres suitable for use in filters according to the present invention are commercially available from Lenzing Aktiengesellschaft under the trademark Tencel®.

The segment of fibrous filtration material formed of the fibres of the degradable composition may comprise at least one sorbent or catalyst capable of removing at least one gas phase constituent from mainstream smoke drawn through the filter. Preferably, the at least one sorbent is selected from the group consisting of activated carbon, activated alumina, zeolites, sepiolites, molecular sieves, silica gel and combinations thereof.

Alternatively or in addition, the segment of fibrous filtration material formed of the fibres of the degradable composition may comprise at least one flavourant capable of releasing flavour into the mainstream smoke drawn through the filter. Suitable flavours to be provided in the filters according to the present invention include, but are not limited to, peppermint, spearmint, coffee, tea, spices (such as cinnamon, clove and ginger), cocoa, vanilla, fruit flavours, chocolate, eucalyptus, geranium, linalool and natural or synthetic menthol.

Suitable forms of flavourant for incorporation into the segment of fibrous filtration material would be known to the skilled person. For example, the flavourant may comprise one or more breakable capsules encapsulating a liquid flavourant, one or more threads impregnated with liquid flavourant, one or more beads impregnated with a liquid flavourant, or flavourant added directly to the fibres, or combinations thereof.

Filters according to the first aspect of the present invention may be single segment filters, consisting of the segment of fibrous filtration material formed of fibres of the degradable composition only. Alternatively, filters according to the first aspect of the invention may comprise multi-component filters comprising two or segments. For example, filters according to the first aspect of the present invention may comprise multi-component filters further comprising at least one of: a rod end segment upstream of the segment of fibrous filtration material and a mouth end segment downstream of the segment of fibrous filtration material.

Throughout the specification, the terms "upstream" and "downstream" are used to describe the relative positions of components of filters according to the invention in relation to the direction of mainstream smoke drawn through the filters during use thereof.

Where present, the mouth end segment or rod end segment may comprise at least one sorbent or catalyst, at least one flavourant, or combinations thereof, in addition to or as an alternative to any sorbent or flavourant incorporated into the segment of fibrous filtration material. Suitable sorbents and flavourants include those described above for use in the segment of fibrous filtration material.

In a second aspect of the invention, a filter is provided which includes a wrapper formed of the degradable composition comprising cellulose acetate and the degradable polymer, the wrapper circumscribing at least a portion of the filter.

Preferably, the wrapper is a plug wrap circumscribing one or more segments of the filter. The term "plug wrap" is used herein to define a wrapper which circumscribes only the filter or a portion of the filter. Where the filter is formed of a single segment, such as a single segment of filtration material, the plug wrap will circumscribe the single segment and will generally be the only material between the underlying segment and the tipping wrapper. Where the mouthpiece is formed of a set of multiple segments, the term "plug wrap" can refer to segment plug wraps which each circumscribe only a single segment or a sub-set of the segments, or the term can refer to a combining plug wrap which circumscribes all of the segments and any segment plug wraps.

The use of a filter wrapper comprising the degradable polymer increases the speed of degradation of the filter. Upon contact with water, the degradable polymer within the wrapper will degrade as described above, thereby breaking down the structure of the wrapper and breaking open the filter to expose the underlying filter material to the environment.

The degradable composition comprising the combination of cellulose acetate and the degradable polymer can readily be formed into a film material that is suitable for use as a filter wrapper. The inclusion of cellulose acetate with the degradable polymer facilitates the processing of the composition into a film and additionally provides the film with the desirable strength.

Preferably, the wrapper is formed of a degradable composition comprising at least about 10 percent by weight of the degradable polymer, more preferably at least about 15 percent by weight, based on total dry weight of the composition. Preferably, the degradable composition comprises less than about 50 percent by weight of the degradable polymer, more preferably less than about 40 percent by weight and most preferably less than about 30 percent by weight, based on the total dry weight of the degradable composition.

In preferred embodiments, the wrapper is formed of a degradable composition comprising between about 10 percent and about 50 percent by weight of the degradable polymer, more preferably between about 15 percent and about 40 percent by weight and most preferably between about 15 percent and about 30 percent by weight, based on the total dry weight of the composition. In a particularly preferred embodiment, the wrapper is formed of a degradable composition comprising about 20 percent by weight of the degradable polymer, based on total dry weight.

In particularly preferred embodiments, the degradable polymer in the degradable composition forming the wrapper is polylactic-co-glycolic acid (PLGA).

Preferably, the degradable composition forming the wrapper comprises at least about 50 percent by weight of cellulose acetate, more preferably at least about 60 percent by weight and most preferably at least about 70 percent by weight, based on the total dry weight of the degradable composition. Preferably, the degradable composition comprises less than about 90 percent by weight of cellulose acetate, more preferably less than about 85 percent by weight, based on the total dry weight of the degradable composition.

In preferred embodiments, the wrapper is formed of a degradable composition comprising between about 50 percent and about 90 percent by weight of cellulose acetate, more preferably between about 60 percent and about 85 percent by weight and most preferably between about 70 percent and about 85 percent by weight, based on the total dry weight of the degradable composition. In a particularly preferred embodiment, the wrapper is formed of a degradable composition comprising about 80 percent by weight of cellulose acetate, based on total dry weight.

Preferably, the degradable polymer and the cellulose acetate constitute substantially all or a majority of the degradable composition forming the wrapper. The wrapper therefore preferably consists essentially of the degradable polymer and cellulose acetate. However, in certain embodiments, additional functional or non-functional components may be incorporated into the degradable composition forming the wrapper. For example, in certain embodiments the degradable composition may include a plasticiser which is incorporated into the composition together with the cellulose acetate and the degradable polymer, prior to the casting of the wrapper. Suitable plasticisers for forming wrappers for smoking articles would be known to the skilled person.

Preferably, the wrapper formed of the degradable composition is substantially transparent. Particularly preferably, the wrapper is a substantially transparent plug wrap. The use of a transparent wrapper enables the consumer to view the underlying filtration material, for example, to observe the effectiveness of the filter or to view any particulate material provided within the filtration material. The ratio of the cellulose acetate and the degradable polymer in the degradable composition forming the wrapper will typically affect the transparency of the wrapper and can be adjusted according to the desired level of transparency.

The term "substantially transparent" is used herein to describe a material which allows at least a significant proportion of incident light to pass through it, so that it is possible to see through the material. In embodiments of the present invention comprising a substantially transparent plug wrap, the substantially transparent plug wrap allows sufficient light to pass through it so that the underlying filter segment is visible through the plug wrap. The substantially transparent wrap may be completely transparent, or the wrap may have a lower level of transparency whilst still transmitting sufficient light such that the mouthpiece segment is visible through the plug wrap.

In embodiments comprising a substantially transparent plug wrap, any underlying or overlying layers such as the tipping wrapper are preferably transparent, have a transparent window or have a cut-out such that the consumer can observe the mouthpiece segment through all of the overlying layers.

Preferably, the wrapper has a haze of less than about 3, more preferably less than about 2.8, when measured using the method of ASTM D1003—Standard Test Method for Haze and Luminous Transmittance of Transparent Plastics. Luminous transmittance is obtained by placing a clear specimen at some distance from the entrance port of the integrating sphere. However, when the specimen is hazy, the total hemispherical luminous transmittance must be measured by placing the specimen at the entrance port of the sphere. The measured total hemispherical luminous transmittance will be greater than the regular luminous transmittance, depending on the optical properties of the sample. With this test method, the specimen is necessarily placed at the entrance port of the sphere in order to measure haze and total hemispherical luminous transmittance.

Preferably, the wrapper formed of the degradable composition has a thickness of between about 25 microns and about 140 microns.

Preferably, the wrapper has a basis weight of between about 50 gsm (grams per square meter) and about 80 gsm.

Preferably, the wrapper is substantially impermeable to air, for example, with an air permeability of less than 10 Coresta units.

Filters according to the invention may comprise a combination of a segment of fibrous filtration material formed of a degradable composition of cellulose acetate and a degradable polymer, and a wrapper formed of the same or a different degradable composition of cellulose acetate and a degradable polymer.

According to the present invention there is further provided a smoking article comprising an aerosol-forming substrate and a mouthpiece secured in axial alignment with the aerosol-forming substrate, the mouthpiece comprising a filter according to the invention as defined above. Preferably, the aerosol-forming substrate and the mouthpiece are secured together by a tipping wrapper that circumscribes the smoking article.

Smoking articles according to the present invention may be filter cigarettes or other smoking articles in which tobacco material or another combustible material is combusted to form smoke. Alternatively, smoking articles according to the present invention may be articles in which an aerosol forming substrate, such as tobacco, is heated to form an aerosol, rather than combusted. In one type of heated smoking article, tobacco material or another aerosol forming material is heated by one or more electrical heating elements to produce an aerosol. In another type of heated smoking article, an aerosol is produced by the transfer of heat from a combustible or heat source to an aerosol forming substrate. The present invention further encompasses smoking articles in which a nicotine-containing aerosol is generated from a tobacco material, tobacco extract or other nicotine source, without combustion, and in some cases without heating, for example through a chemical reaction.

In certain preferred embodiments of the present invention, the aerosol generating substrate of the smoking article comprises a tobacco rod attached to a filter according to the invention.

The fibres of the filter according to the first aspect of the invention as described above may be formed by a method comprising the steps of: forming a solution of cellulose acetate and the degradable polymer in acetone; and forming fibres of the solution by dry solvent spinning. The fibres may then be formed into the shape of a filter segment using conventional filter making techniques and apparatus. Optionally, a plasticiser may be applied to the fibres during formation of the filter segment.

The skilled person shall appreciate that, when dissolved in acetone, the cellulose acetate and the degradable polymer shall intimately mix and so, in the fibres formed from the solution, the cellulose acetate and the degradable polymer shall also remain generally mixed. Without wishing to be bound to theory, this is understood to result in a generally homogenous distribution of both cellulose acetate and the degradable polymer within the fibres. This is in contrast to solutions known in the art, wherein fibres of cellulose acetate are coated with a degradable polymer. Because cellulose acetate and the degradable polymer are intimately mixed within each individual fibre in the filter component, when the degradable polymer begins to degrade, the individual fibres are expected to break down into smaller fragments, and thus to expose an increased surface area to the environment, whereby the degradation rate of the fibres is advantageously further increased. In the first step of the method, cellulose acetate flakes and the degradable polymer are dissolved into acetone solvent to form a solution or 'dope'. Preferably, the solution comprises between about 2 grams and about 36 grams of cellulose acetate per 100 grams of the solution and between about 1 gram and about 30 grams of the degradable polymer per 100 grams of the solution. Optionally, one or more additives such as a plasticiser or colourant may be added into the solution. Preferably, the solution is filtered prior to the spinning process in order to remove any solid residue.

It has been found that the inclusion of the degradable polymer to the solution together with the cellulose acetate does not significantly increase the viscosity of the solution compared to a solution of cellulose acetate in acetone. This advantageously enables the solution of cellulose acetate and the degradable polymer to be processed in the same way as a solution of cellulose acetate, such that the plurality of fibres can be formed using conventional apparatus and techniques for forming cellulose acetate tow.

In the method described above, a plurality of fibres is formed from the solution in a dry solvent spinning process. In such a process, the solution of cellulose acetate and the degradable polymer is preheated and pumped to an array of spinning cells, each comprising a spinneret positioned above an elongate drying chamber. Each spinneret has a head which typically comprises several hundred small holes through which the solution is extruded under pressure. After extrusion, the solution forms an array of fibres which are passed down through the drying chamber to remove the acetone solvent. In the drying chamber, a counter current of heated air may be provided to evaporate the solvent from the fibres.

In the subsequent step, the array of fibres are gathered together and consolidated to form a band of fibres or tow which may be provided to a conventional filter making machine to produce filter segments. A plasticiser may be sprayed onto the fibres during the formation of the tow, in the conventional manner. The fibres are optionally crimped during the formation of the tow, in the conventional manner. For example, the fibres can be crimped using a known method for crimping textile fibres, such as the method described in U.S. Pat. No. 2,647,285.

The wrapper of filters according to the second aspect of the invention as described above, may be formed by a method comprising the steps of: forming a solution of cellulose acetate and the degradable polymer in acetone and casting the solution to form a sheet. The sheet may then be wrapped around one of more filter segments using conventional techniques and apparatus.

The skilled person shall appreciate that, when dissolved in acetone, the cellulose acetate and the degradable polymer shall intimately mix and so, in the sheet cast from the solution, the cellulose acetate and the degradable polymer shall also remain generally mixed. Without wishing to be bound to theory, this is understood to result in a generally homogenous distribution of both cellulose acetate and the degradable polymer within the sheet. This is in contrast to solutions known in the art, wherein a sheet of cellulose acetate is coated with a degradable polymer. Because cellulose acetate and the degradable polymer are intimately mixed within the sheet in the wrapper, when the degradable polymer begins to degrade, the structure of the wrapper is expected to break down and thus to expose an increased surface area to the environment, whereby the degradation rate of the sheet is advantageously further increased.

Preferably, a plasticiser is added into the solution prior to the casting step.

The solution may be formed as described above and may be cast into a sheet or film using conventional techniques which would be known to the skilled person. After casting, the sheet is dried to remove the acetone solvent. The dried sheet can then be used in a conventional filter production apparatus to provide one or more of the wrappers for a filter.

Figure 2:
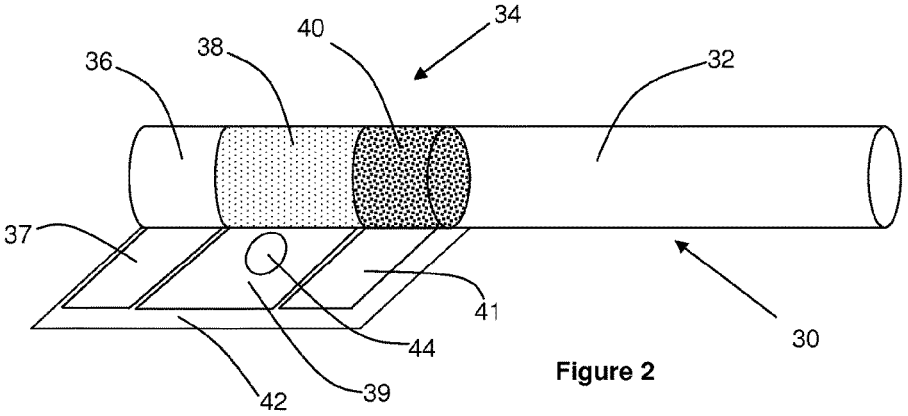

The invention will now be further described, by way of example only, with reference to the accompanying drawings in which:

FIG. 1 shows a smoking article comprising a filter in accordance with the first aspect of the present invention with the filter unwrapped; and FIG. 2 shows a smoking article comprising a filter in accordance with the second aspect of the present invention with the filter unwrapped.

The filter cigarette 10 shown in FIG. 1 comprises a wrapped rod 12 of tobacco cut filler which is attached at one end to an axially aligned filter 14 according to the first aspect of the invention comprising a single filter segment 16 which has been wrapped with a plug wrap 18. The wrapped tobacco rod 12 and the filter 14 are joined by an outer wrapper 20 formed of tipping paper, which circumscribes the entire length of the filter 14 and an adjacent portion of the tobacco rod 12.

The filter segment 16 comprises a plurality of fibres formed of a composition comprising 50 percent by weight of cellulose acetate and 50 percent by weight of polylactic-co-glycolic acid. A plasticiser comprising triacetin has been applied to the fibres in the conventional manner.

The plurality of fibres are formed in a dry solvent spinning process as described above and the filter segment 16 may be produced from the fibres in a conventional manner. To form the filter cigarette 10 the filter 14 is produced and then joined to the wrapped tobacco rod 12, which is produced in a conventional manner, by the tipping paper 16 using known filter cigarette making equipment.

FIG. 2 shows a filter cigarette 30 comprising a wrapped rod 32 of tobacco cut filler which is attached to an axially aligned filter 34 in accordance with the second aspect of the invention comprising three filter segments in abutting end-to-end relationship: a mouth end segment 36, distant from the wrapped tobacco rod 32; a flavour release segment 38, located upstream of the mouth end segment 36; and a rod end segment 40 adjacent to and abutting the wrapped tobacco rod 32 and located upstream of the first flavour release segment 38.

The mouth end segment 36 comprises a plug of cellulose acetate tow of low filtration efficiency. The flavour release segment 38 comprises a plug of cellulose acetate tow through which particles of a suitable flavourant have been dispersed, such as cut peppermint leaf. The rod end segment 40 comprises a plug of cellulose acetate tow of medium to low filtration efficiency loaded with an additive, such as activated carbon. The mouth end segment 36, the flavour release segment 38 and the rod end segment 40 are each wrapped with a segment plug wrap 37, 39, 41. The plug wrap 39 of the flavour release segment 38 is formed of a substantially transparent sheet material comprising 80 percent by weight cellulose acetate and 20 percent by weight polylactic-co-glycolic acid.

The wrapped tobacco rod 32 and the wrapped filter 34 are joined by an outer wrapper 42 formed of tipping paper, which circumscribes the entire length of the filter 34 and an adjacent portion of the tobacco rod 32. The outer wrapper 42 comprises a circular cut-out portion 44 having a diameter of approximately 5 mm which is positioned over the flavour release segment 38, approximately halfway along the length of the segment. The underlying substantially transparent plug wrap 39 is exposed through the cut-out portion 44 in the outer wrapper 42 and an area of the flavour release segment 38 including the cut peppermint leaf is therefore visible through the cut-out portion 44.

To produce the multi-component filter 34 of the filter cigarette 30 shown in FIG. 2, separate continuous rods comprising multiple units of each segment 36, 38, 40 of the multi-component filter. 34 are produced in a known manner. The segments 36, 40 are wrapped in a conventional plug wrap material and the segment 38 is wrapped in a transparent plug wrap formed of a composition comprising cellulose acetate and polylactic-co-glycolic acid. The assembled filter is joined to the wrapped tobacco rod 32 by the outer wrapper 42 with the pre-formed cut-out portion 44.

The invention claimed is:

1. A filter for a smoking article, the filter including a filter component formed from a solution of cellulose acetate and a degradable polymer in acetone, the degradable polymer being soluble in acetone and degrading in the presence of water, wherein the degradable polymer is polylactic-co-glycolic acid.

2. A filter according to claim 1 wherein the filter component is a segment of fibrous filtration material comprising a plurality of fibres formed of the solution comprising cellulose acetate and the degradable polymer.

3. A filter according to claim 1 wherein the solution of cellulose acetate and the degradable polymer in acetone comprises between 10 percent and 75 percent by weight of the degradable polymer, based on total dry weight.

4. A filter according to claim 2 wherein the segment of fibrous material further comprises at least one plasticiser applied to the plurality of fibres.

5. A filter according to claim 4 wherein the plasticiser is selected from the group consisting of triacetin, triethyl citrate and polyethylene glycol.

6. A filter according to claim 2 comprising a plurality of spun fibres of the solution comprising cellulose acetate and the degradable polymer.

7. A filter according to claim 6 wherein the fibres are formed by dry solvent spinning.

8. A filter according to claim 2 further comprising at least one of a rod end segment upstream of the segment of fibrous filtration material and a mouth end segment downstream of the fibrous filter segment.

9. A filter according to claim 1 wherein the filter component is a wrapper formed of the solution comprising cellulose acetate tow and the degradable polymer, the wrapper circumscribing at least a portion of the filter.

10. A filter according to claim 9 wherein the composition forming the wrapper comprises between 10 percent and 50 percent by weight of the degradable polymer, based on total dry weight.

11. A filter according to claim 9 wherein the wrapper is substantially transparent.

12. A filter according to claim 11 wherein the substantially transparent wrapper is a plug wrap and wherein the filter further comprises an outer wrapper overlying the plug wrap, the outer wrapper including a cut-out.

13. A smoking article comprising:

an aerosol-forming substrate; and a mouthpiece secured in axial alignment with the aerosol-forming substrate, the mouthpiece comprising a filter according to claim 1.

14. A smoking article according to claim 13 comprising a tobacco rod attached to the filter.

* * * * *